US008419327B2

(12) United States Patent
Muehlbacher

(10) Patent No.: US 8,419,327 B2
(45) Date of Patent: Apr. 16, 2013

(54) RAIL LOADING TRAIN FOR TRANSPORTING RAILS

(75) Inventor: Christoph Muehlbacher, Teisendorf (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 0 days.

(21) Appl. No.: 13/318,986

(22) PCT Filed: Mar. 10, 2010

(86) PCT No.: PCT/EP2010/001475

§ 371 (c)(1), (2), (4) Date: Nov. 4, 2011

(87) PCT Pub. No.: WO2010/127735

PCT Pub. Date: Nov. 11, 2010

(65) Prior Publication Data

US 2012/0051867 A1 Mar. 1, 2012

(30) Foreign Application Priority Data

May 5, 2009 (DE) ..... 20 2009 006 549 U

(51) Int. Cl.
*B60P 3/40* (2006.01)

(52) U.S. Cl.
USPC ..... 410/32

(58) Field of Classification Search ..... 410/31, 410/32, 38, 44, 77; 414/373; 248/316.1, 248/316.5
See application file for complete search history.

(56) References Cited

U.S. PATENT DOCUMENTS

| | | | | |
|---|---|---|---|---|
| 2,399,833 | A * | 5/1946 | Scofield | 91/275 |
| 3,043,240 | A * | 7/1962 | Hayes | 104/259 |
| 3,461,810 | A * | 8/1969 | Yard | 104/7.1 |
| 3,635,164 | A * | 1/1972 | Patton | 104/307 |
| 4,176,777 | A | 12/1979 | Bommart | |
| 4,377,220 | A * | 3/1983 | Briggs | 188/44 |
| 4,579,061 | A * | 4/1986 | Dieringer | 104/17.1 |
| 5,305,692 | A * | 4/1994 | Madison et al. | 104/9 |
| 6,375,402 | B1 * | 4/2002 | Hertelendi et al. | 414/373 |
| 6,637,340 | B1 * | 10/2003 | Wilson | 104/2 |
| 7,370,586 | B2 | 5/2008 | McHale et al. | |
| 2007/0283837 | A1 * | 12/2007 | Brenny et al. | 104/16 |
| 2008/0232917 | A1 | 9/2008 | Hertelendi | |

FOREIGN PATENT DOCUMENTS

| | | | |
|---|---|---|---|
| EP | 1 561 861 | A2 | 8/2005 |
| GB | 2000829 | A | 1/1979 |
| RU | 2104361 | C1 | 2/1998 |
| WO | 2007/065500 | A1 | 6/2007 |

* cited by examiner

*Primary Examiner* — H Gutman
(74) *Attorney, Agent, or Firm* — Laurence A. Greenberg; Werner H. Stemer; Ralph E. Locher

(57) ABSTRACT

A rail freight train is configured for transporting long welded rails. The train has a device for anchoring the rails disposed on the end of the rail freight train and composed of a number of insertion devices, each provided for anchoring an individual rail. A first clamping jaw is securely connected to the device, while a second clamping jaw is adjustable by way of a clamping wedge displaceable in the longitudinal rail direction.

11 Claims, 2 Drawing Sheets

RAIL LOADING TRAIN FOR TRANSPORTING RAILS

BACKGROUND OF THE INVENTION

Field of the Invention

The invention relates to a rail loading train for transporting long-welded rails, including loading wagons mobile on a track and a device for anchoring the rails, said device being arranged at the end of the rail loading train and being composed of a number of insertion devices provided for anchoring a single rail in each case, each insertion device comprising a first and a second clamping jaw having a respective contact surface to be applied in a force-locking manner to a rail web of the rail.

A rail loading train of this type is already known from WO 2007/065500 A1. This train comprises a device for anchoring the rails which consists of a number of insertion devices. Each insertion device comprises two clamping jaws having a respective movable, roller-shaped clamping means. For force-locking connection of the clamping means to the rail web, or for releasing said connection, the two clamping jaws are designed to be distanced to or from one another.

BRIEF SUMMARY OF THE INVENTION

It is the object of the present invention to create a rail loading train of the kind mentioned at the beginning with which the clamping, required for the transporting operation, of the long rails to be transported can be carried out in a trouble-free and largely automatic manner by means of a structurally simple device.

According to the invention, this object is achieved with a rail loading train of the type mentioned at the beginning and having the claimed features.

With a rail loading train equipped with a device of this type, designed with structural simplicity, for anchoring the rails, it is now possible in an advantageous way to carry out the procedure of clamping rails, and also the releasing of the clamping connection, by remote control without the necessity for direct manual intervention by an operator. During this, the clamping of the long rails can be executed by the driver of the gantry crane directly in the course of the rail loading operation by simply sliding the rail ends into the insertion device, wherein the rails are instantly fixed fully automatically and immovably with a precisely calculable torque value. Likewise, the releasing of the connection can also be carried out fully automatically, or rather by remote control by the crane operator himself. With this, the safety risk for the working personnel can be minimised very much while eliminating unnecessary sources of danger.

Additional advantages of the invention become apparent from the dependent claims and the drawing description.

The invention will be described in more detail below with reference to an embodiment represented in the drawing in which

DESCRIPTION OF THE INVENTION

Figure 1:
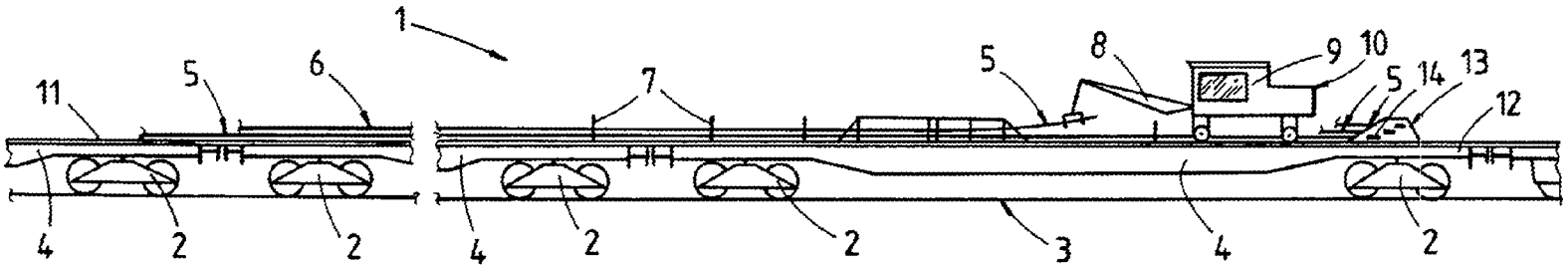
FIG. 1 shows a schematic side view of a rail loading train designed according to the invention.
Figure 2:
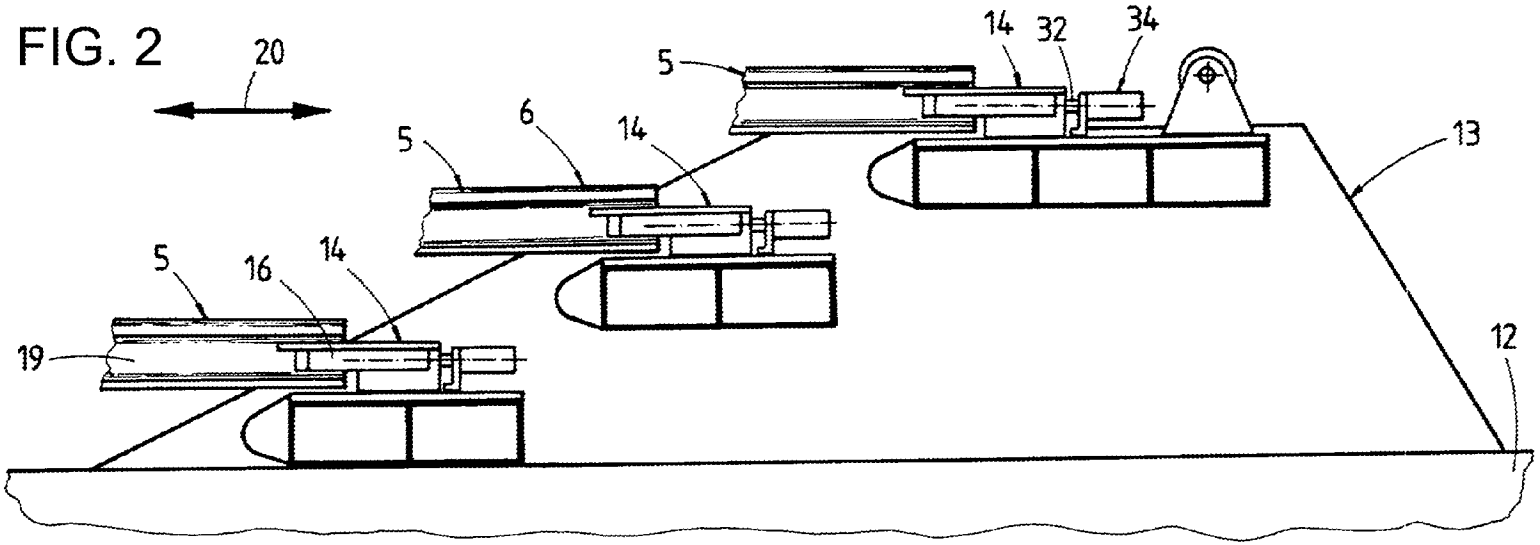
FIG. 2 shows a side view of a device for clamping rails.

A rail loading train 1, shown in FIG. 1, is composed of a number of loading wagons 4 mobile by means of on-track undercarriages 2 on a track 3 and serves for transporting long-welded rails 5. The latter are stored in the conventional manner on support brackets 7 in three layers 6 arranged one above the other. For loading and unloading the rails 5, a crane 10—having a jib 8 and a cabin 9—is provided which is freely mobile along the loading wagons 4 on crane rails 11 and displaces the long-welded rails 5 in the longitudinal direction of the wagon or train. Located at the end 12 of the rail loading train 1 (preferably at both ends) is a device 13 for anchoring the rails 5 during transport, which consists of several insertion devices 14, each provided for anchoring a single rail 5. As becomes clear particularly from FIG. 2, each device 13 comprises several insertion devices 14 spaced from one another in the longitudinal direction 20 of the rail as well as vertically.

Figure 3:
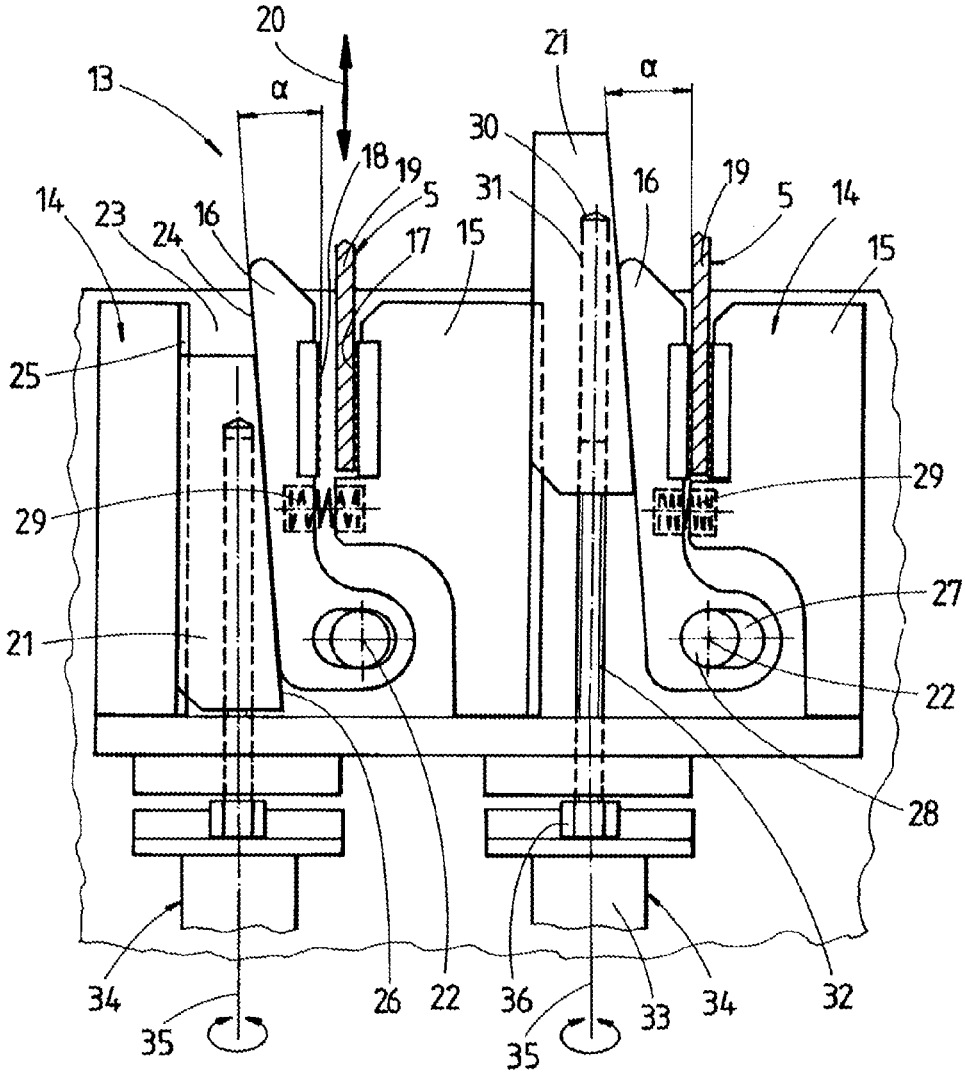
FIG. 3 shows a partial top view of the device.

In FIG. 3 it can be seen that each device 13 comprises at least two insertion devices 14 arranged side by side transversely of the longitudinal direction 20 of the rails. Each insertion device 14 has a first and a second clamping jaw 15, 16, each of which is provided with a contact surface 17, 18, respectively, to be applied to a rail web 19 of the rail 5. (For reasons of clarity, only the rail webs 19 of the rails 5 are illustrated in FIG. 3.) The first clamping jaw 15 is fixedly connected to the device 13, while the second clamping jaw 16 is designed to be adjustable by means of a clamping wedge 21 which is displaceable in the longitudinal direction 20 of the rails.

The second clamping jaw 16 is designed to be movable in a pivot plane 23, extending perpendicularly to the contact surface 17, relative to an axis 22 extending parallel to the contact surface 18, while being distanced from the oppositely-positioned contact surface 17. The second clamping jaw 16 further has a wedge contact surface 24, extending perpendicularly to the pivot plane 23, which is spaced from the contact surface 18 and encloses a wedge angle $\alpha$ with the same. The clamping wedge 21 is designed to be displaceable parallel to the contact surface 17; 18 between the wedge contact surface 24 and a wedge guide 25 and has a clamping jaw contact surface 26 which encloses the wedge angle $\alpha$ with the contact surface 17; 18.

An oblong hole 27 arranged on the second clamping jaw 16 serves for receiving a bolt 28 arranged on the device 13. A pressure spring 29, extending transversely to the longitudinal direction 20 of the rail or in the pivot plane 23, is arranged between the first and second clamping jaw 15, 16.

The clamping wedge 21 includes a bore 30 having a female thread 31 into which a threaded spindle 32 is screwed. By means of a drive 34 in the shape of an oil motor 33, the threaded spindle 32 can be set in rotation about a rotary axis 35, causing the clamping wedge 21 to be moved in the longitudinal direction 20 of the rail. Additionally, a releasing mechanism 36 for manual adjustment of the second clamping jaw 16 is arranged on the threaded spindle 32.

The operation of clamping or releasing the rail 5 is executed as described below. The insertion device 14 depicted at the right-hand side in FIG. 3 shows the clamped rail 5, and the insertion device 14 depicted at the left-hand side shows the released rail 5. After insertion of the rail 5 into the insertion device 14, the drive 34 is actuated, and the rotating movement of the threaded spindle 32 sets the clamping wedge 21 into a linear movement extending in the longitudinal direction 20 of the rail. This causes the second clamping jaw 16, or the contact surface 18 thereof, to be pressed against the rail web 19 and the latter, in turn, to be pressed against the contact surface 17 of the first clamping jaw 15. The second clamping jaw 16—by virtue of its special mounting of the oblong hole 27 surrounding the bolt 28—possesses a certain freedom of movement which precludes the clamping jaw from becoming jammed and guarantees the contact surface 18 to be applied exactly to the rail web 19. By means of the variable drive 34, it is possible to set an exact torque and thus an optimal clamping force. Releasing the rail 5 is executed in the analogue inverse manner by actuating the drive 34 in the inverse direction of rotation. If the drive 34 should fail, the threaded spindle can be turned further manually by means of the releasing mechanism 36, and the rail 5 can be released.

The invention claimed is:

1. A rail loading train for transporting long-welded rails, the train comprising:

loading wagons mobile on a track and a device for anchoring the rails disposed at an end of the rail loading train;

said device having of a plurality of insertion devices each configured for anchoring a single rail;

each said insertion device including a first and a second clamping jaw having a respective contact surface to be applied with force-locking engagement to a rail web of the single rail;

said first clamping jaw being fixedly connected to said device and said second clamping jaw being adjustable; and a clamping wedge displaceable in a longitudinal direction of the single rail and disposed to adjust said second clamping jaw.

2. The rail loading train according to claim 1, wherein said second clamping jaw is mounted displaceably in a pivot plane, extending perpendicularly to said contact surface, relative to an axis extending parallel to said contact surface, and at a spacing distance from an oppositely-positioned said contact surface.

3. The rail loading train according to claim 2, wherein said second clamping jaw is formed with a wedge contact surface, extending perpendicularly to the pivot plane, spaced from said contact surface and enclosing a wedge angle $\alpha$ with said contact surface.

4. The rail loading train according to claim 3, wherein said clamping wedge is mounted displaceably parallel to said contact surface between said wedge contact surface of said second clamping jaw and a wedge guide, and said clamping wedge is formed with a clamping jaw contact surface that encloses a wedge angle $\alpha$ with said contact surface.

5. The rail loading train according to claim 2, wherein a pressure spring, extending transversely to the longitudinal direction of the rail or in said pivot plane, is disposed between said first clamping jaw and said second clamping jaw.

6. The rail loading train according to claim 1, wherein said clamping wedge is formed with a bore having a female thread, and wherein a threaded spindle meshes in said bore and is rotated by way of a drive.

7. The rail loading train according to claim 6, wherein said drive is an oil motor.

8. The rail loading train according to claim 6, which comprises a releasing mechanism for manual adjustment of said second clamping jaw disposed on said threaded spindle.

9. The rail loading train according to claim 1, wherein said second clamping jaw is formed with an oblong hole for receiving a vertical bolt disposed on said device.

10. The rail loading train according to claim 1, wherein each said device comprises at least two insertion devices arranged side-by-side transversely of the longitudinal direction of the rail or perpendicularly to said contact surfaces.

11. The rail loading train according to claim 1, wherein each said device comprises at least two insertion devices spaced from one another in the longitudinal direction of the rail and vertically.

* * * * *